US005209393A

United States Patent [19]

Xapelli

[11] Patent Number: 5,209,393

[45] Date of Patent: May 11, 1993

[54] SEPARATOR FOR FOLDABLE CARDBOARD BOXES

[75] Inventor: Ma J. P. Xapelli, Barcelona, Spain

[73] Assignee: Separinter Sociedad Limitada Separacion Integrada Poligono Industrial Can Casablancas, Barcelona, Spain

[21] Appl. No.: 822,129

[22] Filed: Jan. 17, 1992

[30] Foreign Application Priority Data

Jan. 17, 1991 [ES] Spain ..... 9100106

[51] Int. Cl.[5] ..... B65D 25/04

[52] U.S. Cl. ..... 229/120.27; 229/120.24; 229/120.29

[58] Field of Search ..... 229/120.24, 120.26, 229/120.27, 120.15, 120.18, 120.29

[56] References Cited

U.S. PATENT DOCUMENTS

| | | | |
|---|---|---|---|
| 2,943,762 | 7/1960 | Richardson | 229/120.27 |
| 2,983,426 | 5/1961 | Mueller | 229/120.27 |
| 3,070,276 | 12/1962 | Richardson | 229/120.27 |
| 3,189,244 | 6/1965 | Whalen | 229/120.27 |
| 3,536,246 | 10/1970 | Rosen | 229/120.24 |
| 3,845,898 | 11/1974 | Hackenberg | 229/120.26 |
| 3,980,223 | 9/1976 | Curran | 229/120.27 |
| 4,089,457 | 5/1978 | Wood et al. | 229/120.24 |
| 4,095,735 | 6/1978 | Stone | 229/120.27 |

FOREIGN PATENT DOCUMENTS

| | | | |
|---|---|---|---|
| 226917 | 8/1958 | Australia | 229/120.27 |
| 1538508 | 9/1968 | France | 229/120.26 |
| 896479 | 5/1962 | United Kingdom . | |

*Primary Examiner*—Allan N. Shoap
*Assistant Examiner*—Christopher McDonald
*Attorney, Agent, or Firm*—Bacon & Thomas

[57] ABSTRACT

A multi-sheet separator for use in dividing a foldable box comprises at least first and second separator sheets adapted to be shifted between folded and unfolded positions wherein each of the first and second separator sheets includes first and second strip groups that are hingedly interconnected by first and second flap groups. Each of the first and second strip groups include a plurality of longitudinally extending and laterally spaced strip members which are interconnected by respective laterally extending strips. The first and second separator sheets are arranged such that the respective strip and flap groups are positioned in a substantially common plane when the separator sheet is in its folded position and the first and second strip groups are positioned in substantially parallel planes which are spaced a distance defined by the flap groups when the separator sheet is in its unfolded position. The multi-sheet separator is formed by securing the first strip group of the first separator sheet to the second strip group of the second separator sheet. The first and second separator sheets are adapted to be placed in a foldable box and further adapted to be attached between opposing sidewalls of the foldable box so as to be foldable in unison with the box.

3 Claims, 4 Drawing Sheets

SEPARATOR FOR FOLDABLE CARDBOARD BOXES

SUBJECT OF THE INVENTION

This invention pertains to a separator for foldable cardboard boxes especially intended to accommodate bottles and similar fragile articles.

BACKGROUND TO THE INVENTION

Separators for foldable cardboard boxes are known, made up of sets of crossed sheets with complementary fitting cuts; part of the sheets is secured only to one inner face of the box while the remaining plates are coupled to the former only by fitting into their respective cuts, without being secured to the sides of the box.

Such separators must be opened at the same time as the box, although in practice, this is frequently not the case as they have limited points at which to fix onto the sides of the box.

Another problem with the known separators is that, when they are folded, they are excessively thick, making it difficult to fold the box flat, so that it takes up more space than is desirable.

A further problem which can be referred to with such separators is that they have to be fitted inside the box once it has been shaped, making for a complicated and slow operation which increases the total cost of manufacture of the compartmentalized box.

DESCRIPTION OF THE INVENTION

To overcome the drawbacks associated with the prior art, the separator of the present invention has been conceived for folding cardboard boxes, with numerous advantages over known types, as will be explained.

The separator in question is of the type formed by sheets of cardboard or other like material linked together to form a number of divisions: some of the sheets are secured to one of the sides of the box so that they fold and unfold at the same time as the box.

On the basis of this known design, the separator is essentially characterized by the fact that it consists of a set of sheets which, in the closed position, are juxtaposed along one side. The sheets are linked together by transverse flaps pressed on the sheets themselves. The flaps are linked to the two adjacent sheets by folding lines which enable them to be folded and unfolded, while the flaps on the two outside sheets of the group are linked to opposite sides of the box.

More specifically, the sheets are fitted with rows of partially pressed flaps which form transversal strips, the opposite ends of which are shaped along folding lines into strips which form part of the sheet itself. The strips are connected by glue points to the adjacent sheets so that the wings form folding partitions located transversely between each pair of sheets. The strips of the two sheets on the outside faces of the group are connected to two inside opposite faces of the folding box.

The wings are shaped from the sheet of which they form part of along folding lines running in opposite directions.

DESCRIPTION OF THE DRAWINGS

For a better grasp of the invention, reference will into be made to the drawings which, by way of illustration only, show a practical design for this separator, wherein.

DETAILED DESCRIPTION OF THE PREFERRED EMBODIMENT

Figure 1:
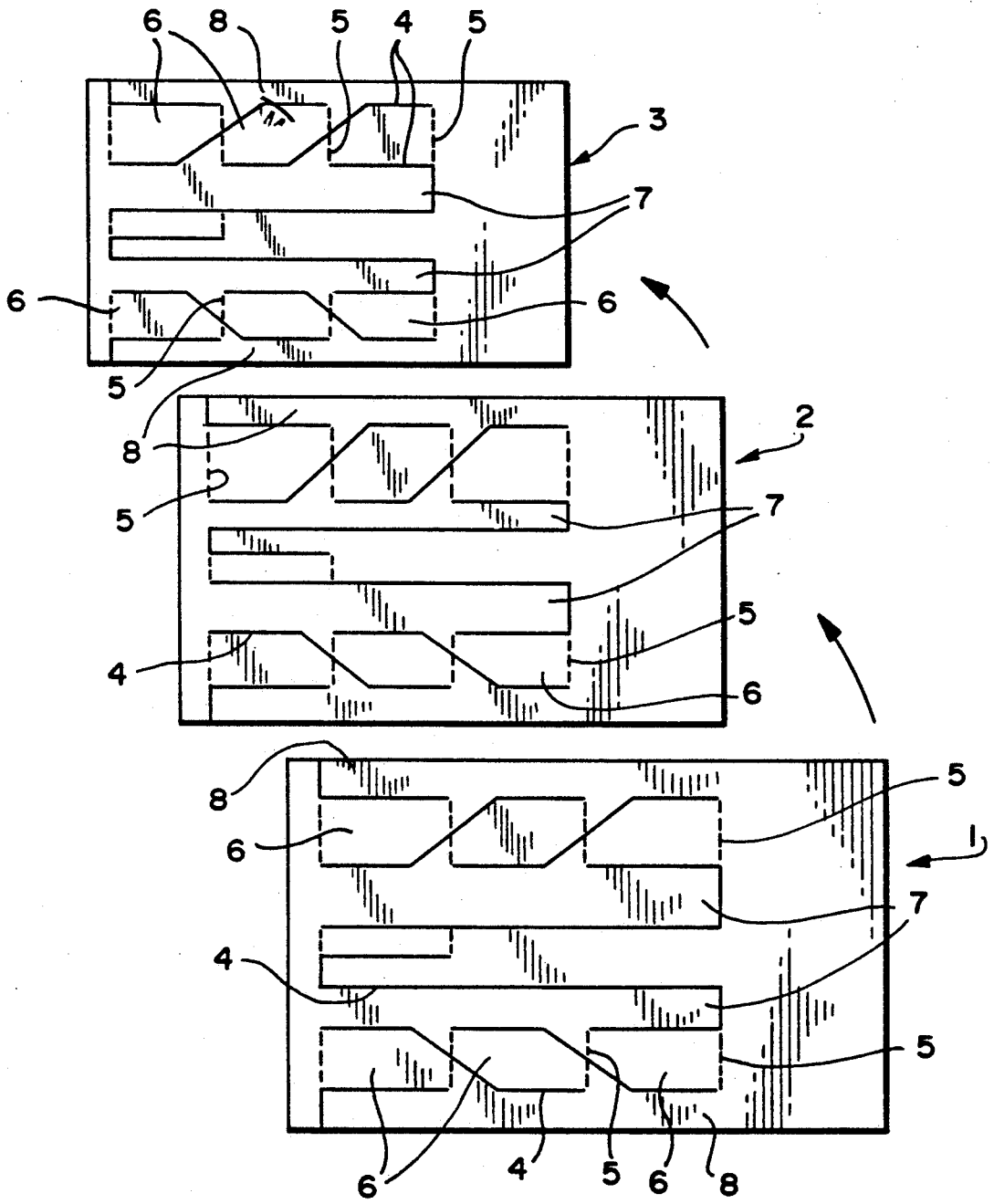
FIG. 1 is a perspective view of three pressed sheets before being put together, and from which the separator is formed.
Figure 2:
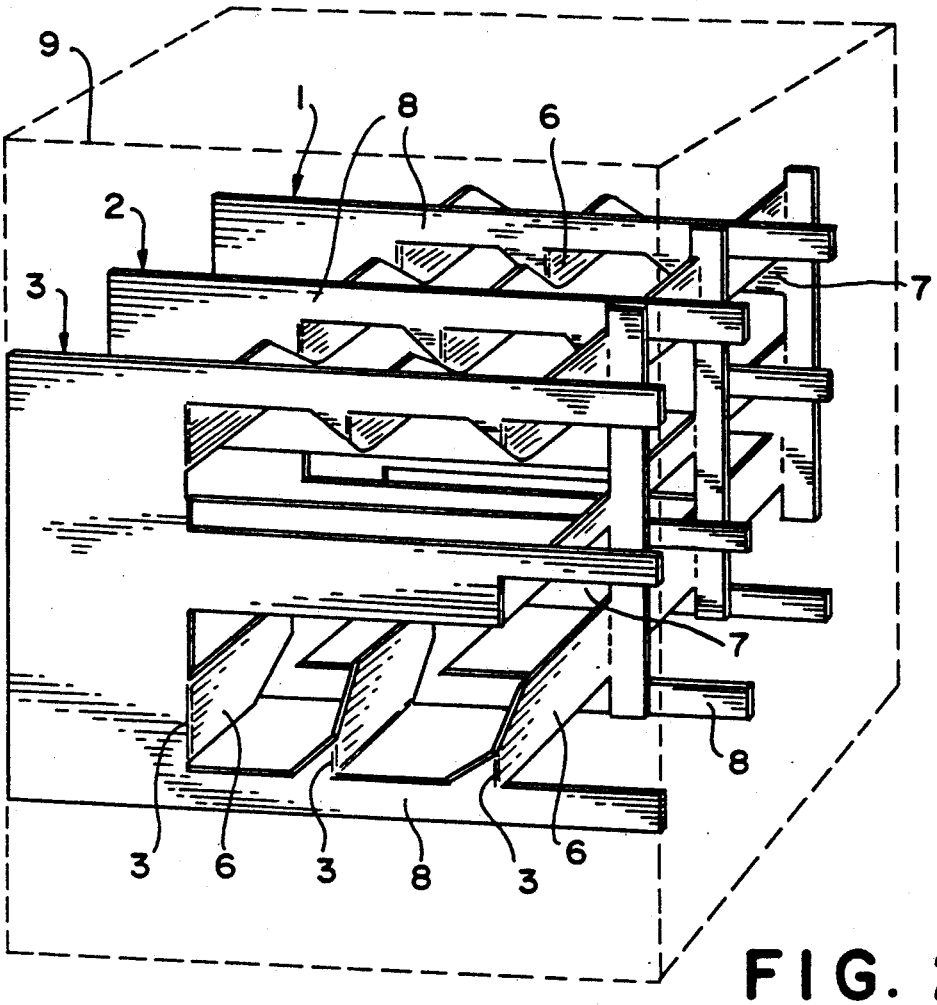
FIG. 2 is a perspective view of the unfolded separators.
Figure 3:
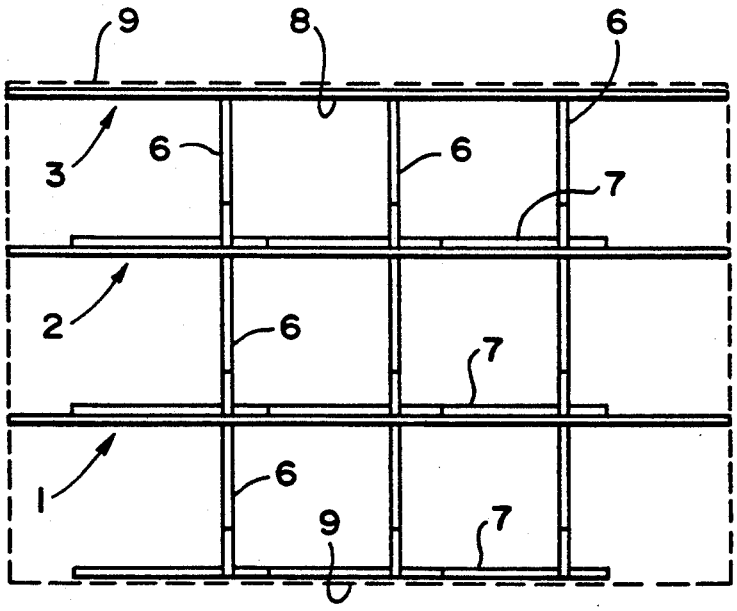
FIG. 3 is a plan view of the separator when unfolded.
Figure 4:
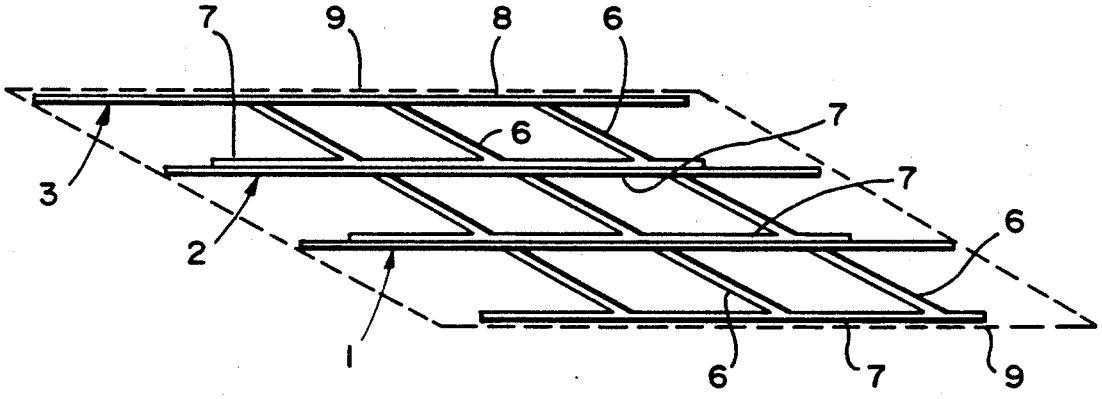
FIG. 4 is a plan view of a partially unfolded separator.
Figure 5:
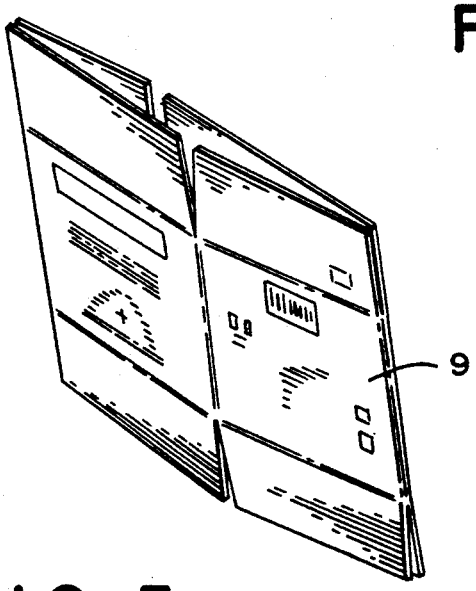
FIG. 5 is a perspective view of a folded box for use with the separator of the present invention.

The separator for foldable cardboard boxes is made up of three cardboard sheets (1-2-3) with cut lines (4) and further folding lines (5) which form a number of flaps (6) on each sheet which constitute transverse strips, the ends of which are defined by the folding lines (5) running in opposite directions, on strips (7-8) pressed onto the sheet itself.

The strips (7) of the sheets (2-3) are secured respectively to the adjacent sheets (1 and 2). On the other hand, the strips (7) of sheet (1) located on one of the outside faces of the group of sheets are secured to one of the inside faces of a box (9) and the strips (8) of the other outside sheet (3) are secured to the opposite side of the box.

As can be seen from the drawings, sheets (1-2-3) are linked by the flaps (6) folded from the strips (7-8) of the sheet itself, and which are secured together at glue points on one sheet to the next, while those on the outsides of the set are glued to the opposite sides of the box (9).

The set of sheets folds and unfolds at the same time as the box (9) because it is secured to the two opposite sides of the box. In the unfolded position, the sheets take the form of a number of compartments or spaces intended to hold bottles or other articles of the sort.

Figure 6:
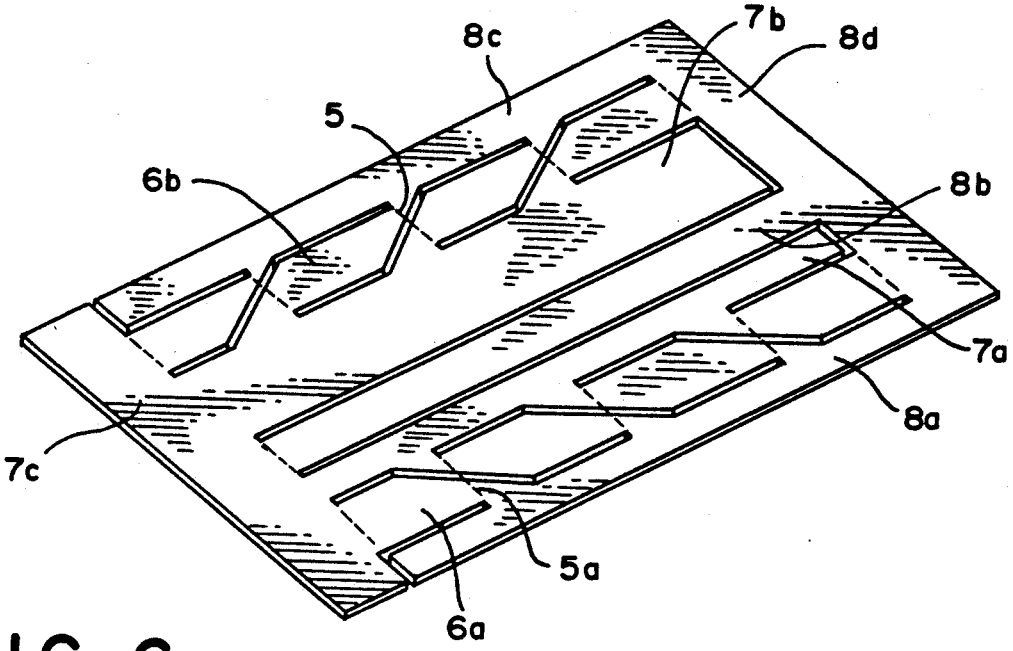
FIG. 6 is a perspective view of a separator sheet overall.
Figure 7:
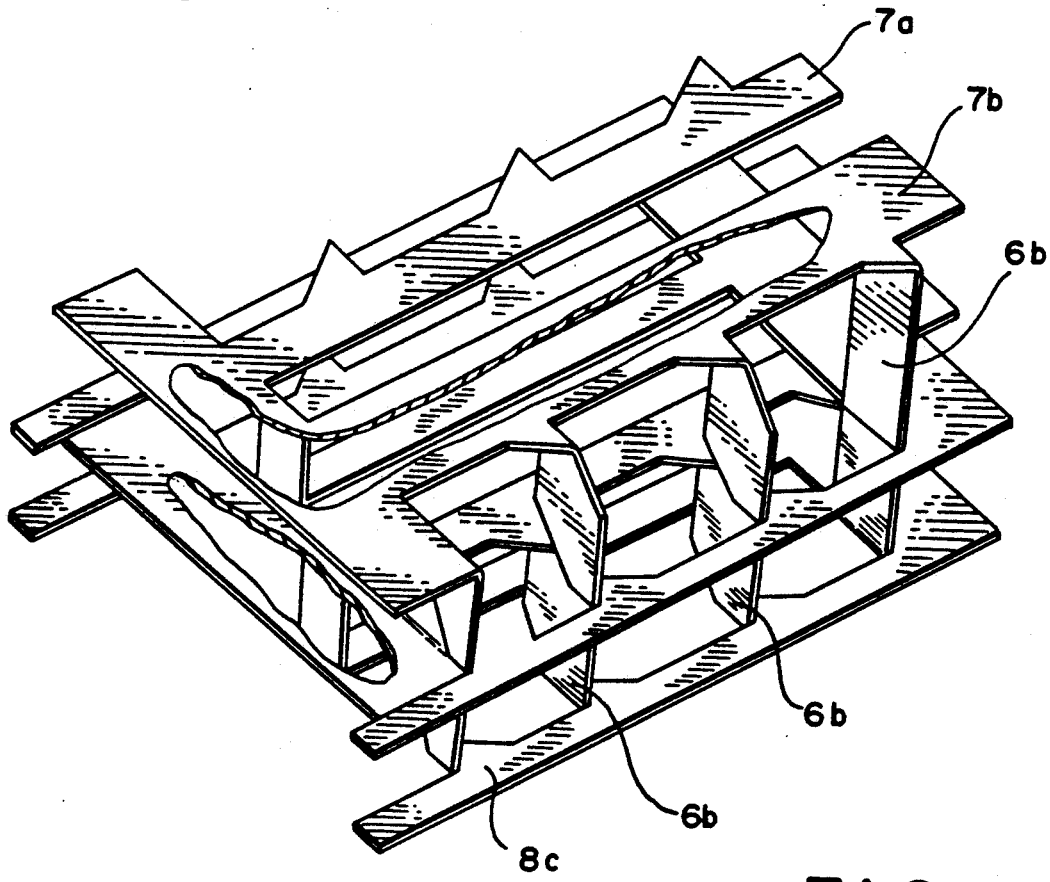
FIG. 7 is a perspective view of the assembly of two sheets.

As best illustrated in FIG. 6 which depicts a single separator sheet according to the present invention in its folded position, the separator sheet includes a first strip group comprised of first and second longitudinally extending and laterally spaced strip members **7*a*, 7*b* and a second strip group comprised of first, second and third longitudinally extending and laterally spaced strip members 8*a*, 8*b* and 8*c*. These longitudinally extending and laterally spaced strip members are interconnected by respective first and second lateral strips 7*c* and 8*d*. As shown in FIG. 6, the first strip member 7*a* of the first strip group is hingedly interconnected with first strip member 8*a* of the second strip group by a first flap group comprised of flaps 6*a*. In a similar manner, second strip member 7*d* of the first strip group is hingedly interconnected with the third strip member 8*c* of the second strip group by a second flap group comprised of flaps 6*b*. When the separator sheet is in its folded position, the first and second strip groups, along with the first and second flap groups, are substantially located in a common plane and, as best shown in FIG. 7, when the separator sheets are moved to their unfolded positions the first and second strip groups are positioned in substantially parallel planes which are spaced a distance defined by flaps 6*a* and 6*b***.

In relation to known types of separators, this one has the advantage that the compartments are formed by narrow strips and flaps thereby in large part preventing rubbing between the separator and the labels on the bottles.

A further advantage of the separator is that, once folded, it is of reduced thickness, equal to the number of sheets, three in the example shown. Known designs, using crossed sheets, are thicker as a greater number of sheets is used to form the divisions.

The separator described is of lower cost since its production can be automated, consisting as it does of an optional number of sheets pressed and glued at given points. The separators constitute a unit which can be incorporated into the box either as it is manufactured or later, thereby significantly reducing production time and, therefore, cost.

The materials used to manufacture the separator components are independent of the subject of this invention, as are their shapes and sizes and any ancillary details which may arise, provided that this does not affect its essential nature.

I claim:

1. A multi-sheet separator for use in dividing a foldable box having at least two opposing sidewalls comprising:

at least first and second separator sheets adapted to be shifted between folded and unfolded positions, each of said first and second separator sheets including first and second strip groups that are hingedly interconnected by first and second flap groups, said first strip group including a plurality of longitudinally extending and laterally spaced strip members which are interconnected by a first laterally extending strip, said second strip group including a plurality of longitudinally extending and laterally spaced strip members which are interconnected by a second laterally extending strip, each of said first and second separator sheets being arranged such that its respective said strip and flap groups are positioned in a substantially common plane when said separator sheet is in its folded position and said first and second strip groups are positioned in substantially parallel planes which are spaced a distance defined by said flap groups when said separator sheet is in its unfolded position, said first and second separator sheets being adapted to be attached between opposing sidewalls of a foldable box so as to be foldable in unison with the box.

2. A multi-sheet separator as claimed in claim 1, wherein said first strip group of said first separator sheet is fixedly secured to said second strip group of said second separator sheet.

3. A multi-sheet separator as claimed in claim 1, wherein each said first strip group comprises first and second longitudinally extending and laterally spaced strip members and each said second strip group comprises first, second and third longitudinally extending and laterally spaced strip members, said first strip member of said first strip group being hingedly interconnected with said fist strip member of said second strip group by said first flap group and said second strip member of said first group being hingedly interconnected with the third strip member of said second strip group by said second flap group.

* * * * *